US005636318A

United States Patent [19]

Polaert et al.

[11] Patent Number: 5,636,318

[45] Date of Patent: Jun. 3, 1997

[54] AIR CIRCULATION HEATING APPARATUS PROVIDED WITH AN INFRARED CONTROL UNIT AND AIRFLOW SCREEN ASSOCIATED THEREWITH

[75] Inventors: Rémy Polaert, Villecresnes; Jean-Pierre Hazan, Sucy; Jean-Louis Nagel, Limeil Brevannes, all of France

[73] Assignee: U.S. Philips Corporation, New York, N.Y.

[21] Appl. No.: 401,758

[22] Filed: Mar. 9, 1995

[30] Foreign Application Priority Data

Mar. 16, 1994 [FR] France ..... 94 03079

[51] Int. Cl.[6] ..... A45D 20/12

[52] U.S. Cl. ..... 392/380; 392/360; 34/268; 34/283; 34/97; 374/208

[58] Field of Search ..... 392/380, 379, 392/381–385, 360, 361, 363–370, 373, 375–378; 34/268, 269, 283, 96–101, 553, 554; 374/208

[56] References Cited

U.S. PATENT DOCUMENTS

| | | | |
|---|---|---|---|
| 2,900,821 | 8/1959 | Rich | 374/208 |
| 4,167,820 | 9/1979 | de Groot | 34/97 |
| 4,424,437 | 1/1984 | Walter et al. | 392/383 |
| 5,200,975 | 4/1993 | Kato | 373/109 |
| 5,511,322 | 4/1996 | Fertig | 392/385 |
| 5,560,121 | 10/1996 | Fertig et al. | 34/90 |

FOREIGN PATENT DOCUMENTS

| | | | |
|---|---|---|---|
| 2471055 | 6/1981 | France . | |
| 2598803 | 11/1987 | France . | |
| 2719963 | 11/1978 | Germany | 392/381 |
| 4117708 | 9/1991 | Germany . | |
| 4208680 | 9/1993 | Germany . | |
| 58-221326 | 12/1983 | Japan . | |
| 1-296037 | 11/1989 | Japan . | |
| 4-33602 | 2/1992 | Japan . | |
| 4-308397 | 10/1992 | Japan . | |
| 5-72043 | 3/1993 | Japan . | |
| 5-95813 | 4/1993 | Japan . | |
| 5-184420 | 7/1993 | Japan . | |
| 5-220010 | 8/1993 | Japan . | |
| 6-38827 | 2/1994 | Japan . | |
| 2093343 | 9/1982 | United Kingdom . | |
| 9419983 | 9/1994 | WIPO . | |
| 9419982 | 9/1994 | WIPO . | |
| 94199982 | 9/1994 | WIPO | 392/385 |

*Primary Examiner*—John A. Jeffery
*Attorney, Agent, or Firm*—Ernestine C. Bartlett

[57] ABSTRACT

An air circulation heating apparatus, for example a hair drier or an electric radiator, is controlled by an infrared sensor which measures at a distance the thermal radiation emitted by an object heated by the apparatus. The sensor is placed in the flow of hot air to ensure reliable operation of the apparatus and to ensure that the sensor supplies correct measurement data. A screen is provided adjacent the sensor in the path of the airflow which prevents the flow of hot air from hitting the sensor directly.

6 Claims, 2 Drawing Sheets

AIR CIRCULATION HEATING APPARATUS PROVIDED WITH AN INFRARED CONTROL UNIT AND AIRFLOW SCREEN ASSOCIATED THEREWITH

FIELD OF THE INVENTION

The invention relates to an air circulation heating apparatus comprising a housing with an air inlet and an air outlet between which are arranged means for supplying a hot air flow, which means comprise air circulation means and air heating means, detection means for measuring a radiation emitted by a body subjected to the hot air flow, and means for controlling the heating means as a function of the measured emitted radiation.

This may relate, for example, to a hair drier, an electric radiator with air circulation, or other appliances.

BACKGROUND OF THE INVENTION

Drying of the hair implies that the water held by the hairs is made to evaporate by means of a flow of hot air. This is obtained by means of a fan which supplies the air flow, the latter being heated by making passing contact with heating means. At the start of the evaporation process, the water held by the hairs forms a thermal screen which prevents burning of the scalp. In proportion as the water evaporates, it acts less and less as a screen, and the hot air flow may cause a burning sensation, and may even cause burning of the scalp as well as drying-out and deterioration of the hair.

To avoid the hair and the scalp being subjected to excessive temperatures during the drying process, the idea has arisen to measure the hair temperature.

One of the methods using detectors without direct contact with the hair is described in the document GB 2.093.343 A. This method measures at a distance the temperature of the hair by means of an infrared sensor which is positioned outside the body of the hair drier. An optical system renders it possible to focus on the location of the hair which is receiving the drying treatment. The infrared detector acts on the heating means when a given temperature is reached.

A hair drier of this type, however, has certain disadvantages. In particular, the focusing point of the infrared sensor must coincide with the heated zone. It is necessary therefore to keep the hair drier at a fixed distance in order to obtain a correct operation. The measurement is incorrect owing to the parallax with too short or too long distances then, and the action of the detector on the heating means is not carried out correctly, which leads to the burns described above. This is especially disadvantageous when a third person handles the hair drier: a hairdresser on a client, hair drying on a child, or when a person dries long hairs, in which case there is no sensorial alarm.

Another type of appliance to which the invention relates is formed by radiators which generate a flow of hot air. Such a radiator may be so arranged that a body can be subjected to the action of the flow of hot air whereby the temperature assumed by said body becomes abnormally high, which may lead to its deterioration.

These situations arise, for example, with:

a cloth held in front of a radiator, a mobile radiator being placed close to an object: curtain, piece of furniture, or other objects, or any other similar situation.

SUMMARY OF THE INVENTION

The invention has for its object to avoid all risk of burning in the use of such a heating apparatus. In the particular case of a hair drier, the aim of the invention is to avoid all risk of burning while nevertheless the user is not obliged to handle the hair drier in an excessively precise manner.

This object is achieved in a heating apparatus wherein the detection means are arranged in the path of the hot air flow, between the body and the air circulation means.

The following description relates preferably to the case of a hair drier, but those skilled in the art may readily find therein the teachings necessary for applications to alternative heating appliances, assuring in these appliances a high degree of operational safety.

Whatever the distance at which the hair drier is held in relation to the hair, the detector will now always exactly view the zone which receives the flow of hot air; there will be no more problems of parallax, and thus of erroneous measurements. There will be no risk of burning as a result.

Preferably, the detection means are placed on or very close to the axis of propagation of the flow of hot air.

It may be desirable for ensuring a convenient operation, depending on the type of the detection means, to provide means for reducing temperature rises of the detection means and which originate from the heating means. This may be a screen which prevents the flow of hot air from hiring the detection means directly.

These and other aspects of the invention will be further clarified with reference to the embodiments described further below.

BRIEF DESCRIPTION OF THE DRAWINGS

The invention will be better understood through reference to the following Figures which are given by way of non-limitative examples, and in which.

DESCRIPTION OF PREFERRED EMBODIMENTS

Figure 1:
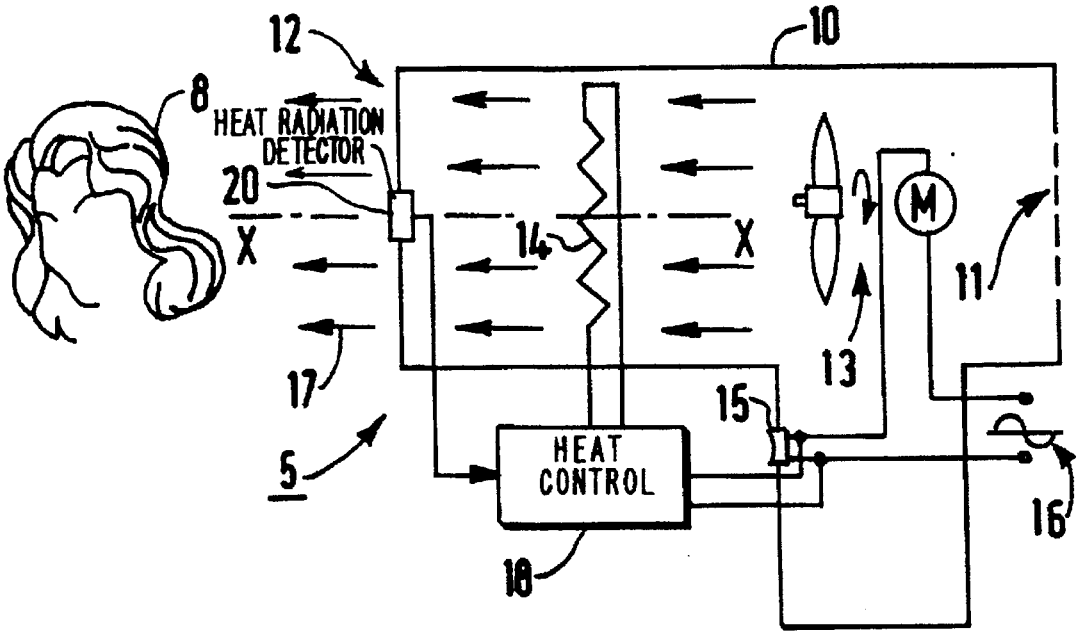
FIG. 1 is a diagram of a hair drier according to the invention.

FIG. 1 shows a hair drier 5 comprising a housing 10 and, between an air inlet 11 and an air outlet 12, air circulation means 13 followed by means 14 for heating the circulated air. The air circulation means 13 are formed, for example, by a fan. The air circulation means 13 and the means 14 are connected to an electric power supply 16 and may be switched on for heating the air by means of a switch 15. During operation of the hair drier, the user directs the flow of hot air 17 issuing from the air outlet 12 at the hair 8.

According to the invention, means 20 for measuring the heat radiation emitted by the hair are placed in the path of the hot air flow 17, for example, an infrared sensor. The sensor 20 is connected to means 18 for controlling the heating means 14 in dependence on the temperature measured at the hair. For this purpose, a given temperature is fixed and, when it is reached, the control means 18 reduce or stop the operation of the heating and/or blowing means 14, 13. The arrangement of the sensor renders it possible for this sensor to detect the temperature variations of that zone of the hair which is in full receipt of the flow of hot air. A parallax effect is not present any more, and therefore it is not necessary to maintain a certain distance in order to obtain a satisfactory operation.

This offers the advantage that it is no longer possible to cause burns in that one zone is heated while the temperature of another zone is measured.

Preferably, the sensor is placed on the axis XX of symmetry of the flow of hot air. Alternatively, however, it may be outside this axis.

It is possible to use any sensor capable of measuring an infrared radiation emitted by the hair and capable of being accommodated in the path of the hot air flow, while disturbing this flow only slightly. For example: a sensor whose resistance depends on the temperature, a pyroelectric sensor, a thermocouple sensor, or alternative sensors.

For detecting the heat flow, a sensor is preferably used that is formed by a plurality of elementary cells which generate a thermoelectric power. One cell is formed by a stack of conductor and/or semiconductor layers such that the cell generates an electrical potential difference induced in response to a heat flow. Such a sensor is described, for example, in the documents FR 2,471,055 and FR 2,598,803.

Such a sensor offers the advantage not only that it comprises a large number of elementary cells (several hundreds) so as to supply a high signal level, but also that

- it has a low thermal inertia,
- it has small dimensions, which renders it possible to arrange it in the outlet of the hair drier without appreciably altering the flow of hot air,
- it has an angular field which is wide enough for capturing the thermal radiation coming from the hair without the necessity of using a focusing objective,
- it covers the range of temperatures prevalent during the operation of a hair drier.

Figure 2:
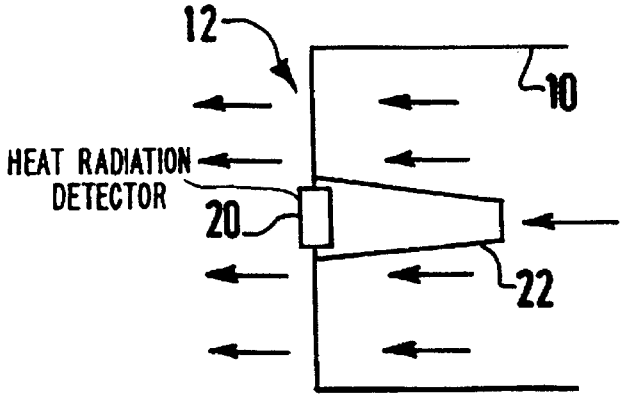
FIGS. 2 and 3 are two diagrams of the outlet of the hair drier with a sensor protected by means for limiting its temperature rise.
Figure 3:
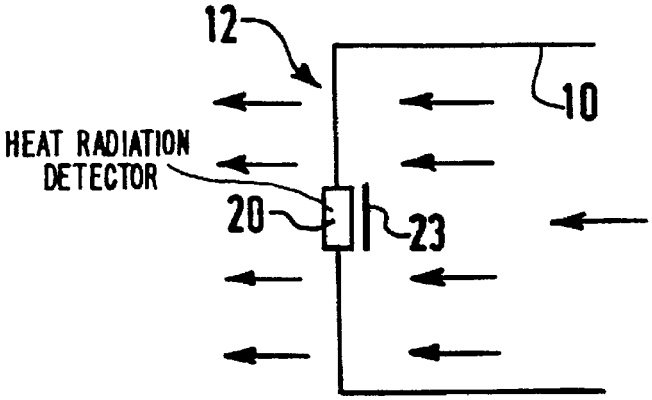

Nevertheless, as shown in FIG. 2, it is possible to protect the sensor with protection means 22 which prevent the hot air from hitting the rear of the sensor directly. This may be a protective jacket which deviates the flow of hot air and keeps it away from the sensor. The jacket may be reduced to a screen 23 (FIG. 3).

Figure 4:
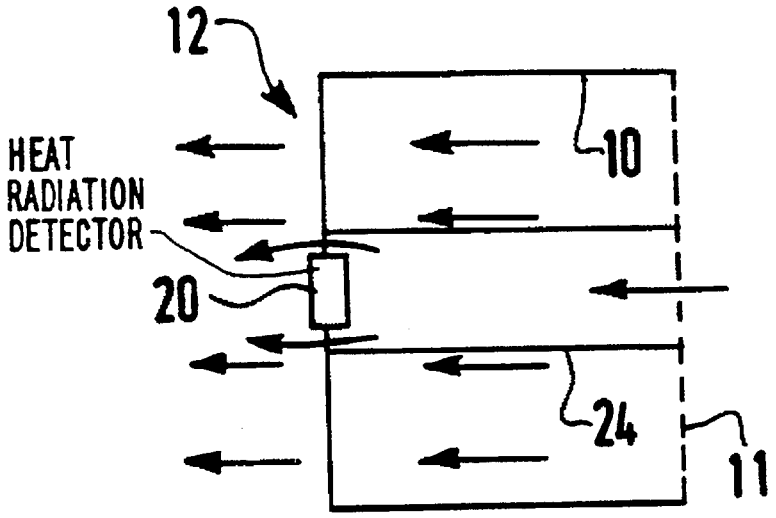
FIG. 4 is a diagram of the outlet of the hair drier with a sensor protected by a jacket of unheated air.

It may alternatively be a jacket 24 traversed by air coming from the inlet 11 for unheated air and serving to cool the temperature sensor (FIG. 4).

It is possible to add to the temperature sensor 20 collimation means for enabling the sensor to observe only that portion of the hair which is subjected to the flow of hot air.

Figure 5:
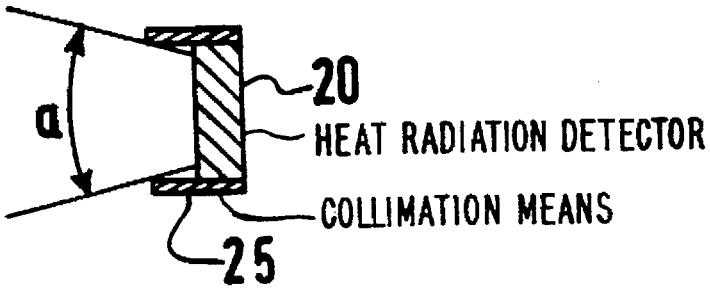
FIGS. 5 and 6 present two diagrams of a sensor with collimation means.
Figure 6:
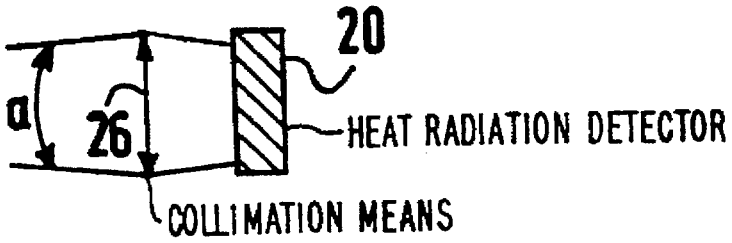

A limitation of the aperture of the thermal beam may be obtained by providing a piece 25 which projects past the sensor 20 (FIG. 5). It is alternatively possible to obtain the limitation of the aperture by placing a lens 26 (FIG. 6) which focuses the thermal radiation on the sensor 20.

We claim:

1. An air circulation heating apparatus (5) comprising a housing (10) with an air inlet (11) and an air outlet (12) between which are arranged means for supplying a hot air flow, said means for supplying a hot air flow comprising air circulation means (13) and air heating means (14), detection means (20) for measuring a heat radiation emitted by a body (8) subjected to the hot air flow, and means (18) for controlling the heating means (14) as a function of the measured emitted radiation, wherein the detection means (20) is arranged in the path of the hot air flow between the body (8) and the air circulation means (13), and wherein means are provided for reducing temperature increase of the detection means (20) as a result of the hot air flow supplied by said means for supplying a hot air flow.

2. An air circulation heating apparatus as claimed in claim 1, characterized in that the detection means (20) are placed on the axis (XX) of propagation of the hot air flow.

3. An air circulation heating apparatus as claimed in claim 2, which is provided with collimation means (25, 26) which limit to a beam of small aperture (a) the thermal radiation emitted by the body (8) and arriving at the detection means (20).

4. An air circulation heating apparatus as claimed in claim 1 wherein said means (22) for reducing the temperature increase of the detection means comprise a screen (23) which prevents the flow of hot air from hitting the detection means (20) directly.

5. An air circulation heating apparatus as claimed in claim 4, which is provided with collimation means (25, 26) which limit to a beam of small aperture (a) the thermal radiation emitted by the body (8) and arriving at the detection means (20).

6. An air circulation heating apparatus as claimed in claim 1 which is provided with collimation means (25, 26) which limit to a beam of small aperture (a) the thermal radiation emitted by the body (8) and arriving at the detection means (20).

* * * * *